US009756883B1

(12) United States Patent
Luevano et al.

(10) Patent No.: US 9,756,883 B1
(45) Date of Patent: Sep. 12, 2017

(54) SAFETY VEST SYSTEMS

(71) Applicants: Edward Luevano, La Puente, CA (US); Carmen M. Luevano, La Puente, CA (US); Mario E. Moet, La Puente, CA (US)

(72) Inventors: Edward Luevano, La Puente, CA (US); Carmen M. Luevano, La Puente, CA (US); Mario E. Moet, La Puente, CA (US)

( * ) Notice: Subject to any disclaimer, the term of this patent is extended or adjusted under 35 U.S.C. 154(b) by 0 days.

(21) Appl. No.: 15/074,751

(22) Filed: Mar. 18, 2016

Related U.S. Application Data

(60) Provisional application No. 62/135,624, filed on Mar. 19, 2015.

(51) Int. Cl.

| | |
|---|---|
| ***A41D 1/04*** | (2006.01) |
| ***A41D 13/012*** | (2006.01) |
| ***A41D 31/00*** | (2006.01) |
| ***A41D 15/00*** | (2006.01) |

(52) U.S. Cl.
CPC ..... *A41D 13/0125* (2013.01); *A41D 1/04* (2013.01); *A41D 15/00* (2013.01); *A41D 31/0011* (2013.01)

(58) Field of Classification Search
CPC ..... A41D 1/04; A41D 13/018; A63B 71/12; B63C 11/04; B63C 9/08; B63C 9/115; B63C 9/155
USPC ..... 2/102, 462, 2.17, DIG. 3; 441/88, 106, 441/108
See application file for complete search history.

(56) References Cited

U.S. PATENT DOCUMENTS

| | | | | |
|---|---|---|---|---|
| 3,742,538 | A | 7/1973 | Smith | |
| 5,013,271 | A * | 5/1991 | Bartlett | A41D 13/0125 441/102 |
| 5,030,153 | A | 7/1991 | Bailey | |
| D424,153 | S * | 5/2000 | Shaffer | D2/731 |
| 6,328,618 | B1 * | 12/2001 | Fleischli | B63C 9/093 2/456 |
| 6,871,357 | B2 | 3/2005 | Herman et al. | |
| 2006/0034064 | A1 * | 2/2006 | Kanzler | A41D 13/01 362/84 |
| 2007/0049141 | A1 * | 3/2007 | Staver | A41D 7/001 441/115 |
| 2013/0005203 | A1 * | 1/2013 | Barbis | B63C 9/11 441/106 |
| 2014/0213128 | A1 * | 7/2014 | Hughes | B63C 9/1255 441/92 |

* cited by examiner

*Primary Examiner* — Tejash Patel
(74) *Attorney, Agent, or Firm* — RG Patent Consulting, LLC; Rachel Gilboy

(57) ABSTRACT

A safety vest is a wearable life preserver which features closures in the back, as opposed to the front, as used to prevent users from easily removing their life jackets, alleviating the risk of accidental drowning.

17 Claims, 4 Drawing Sheets

SAFETY VEST SYSTEMS

CROSS-REFERENCE TO RELATED APPLICATION

The present application is related to and claims priority from prior provisional application Ser. No. 62/135,624, filed Mar. 19, 2015 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of life preservers and more specifically relates to wearable life preservers that feature closures in the back, as opposed to the front to prevent users from easily removing their life jackets, alleviating the risk of accidental drowning.

2. Description of the Related Art

The warmth of the summer season makes it the perfect time of year to indulge in all manners of outdoor activities. From playing a spirited game of volleyball on a sand-packed beach or lounging by the neighborhood pool to spending the day at the park or embarking on a camping adventure, people seek myriad ways to bask in this season's pleasantly balmy days and evenings. Perhaps no other summer pastime is more popular than riding the currents of a body of water in a floating vessel, or boat. Whether cutting through ocean waves on a luxurious yacht, navigating a placid lake on a pontoon, or steering a fishing boat down a lazy river, boaters are out on the water in record numbers come summer time, reveling in activities that are rife with sport, fun, and relaxation.

Even though recreational boaters are looking for nothing but fun when they head to the water, boating trips can sometimes turn to tragedy. According to alarming statistics provided by the United States Coast Guard, there are almost five thousand boating accidents in the U.S. each year; of this number, 3,000 people are injured and 700 die. Approximately seventy-two percent of the fatalities result from drowning, with eighty-eight percent of these victims not wearing life jackets. Obviously, wearing a life-preserving vest is of the utmost importance when boating, or entering into any body of water including backyard pools, if one is unable to swim. This is especially true for children, as they are the most at risk from unintentional drowning; in 2009, thirty percent of children ages one to four who died from unintentional injury succumbed to drowning.

Unfortunately, even if conscientious parents and caregivers outfit their children with life vests, the units are not infallible. Indeed, since the unit's snaps, zippers, and closures are positioned on the front, it is not difficult for a restless child, feeling hampered by the vest, to quickly remove the jacket; should this child fall from a boat or into a backyard pool, tragedy is sure to occur.

Various attempts have been made to solve the above-mentioned problems such as those found in U.S. Pat. No. 6,871,357 to Talia Herman et al; U.S. Pat. No. 5,030,153 to J. Trevor Bailey; and U.S. Pat. No. 3,742,538 to E Us Smith. This prior art is representative of life preservers. None of the above inventions and patents, taken either singly or in combination, is seen to describe the invention as claimed.

Ideally, a life preserver should provide comfort, and ease of use and, yet would operate reliably and be manufactured at a modest expense. Thus, a need exists for a reliable safety vest system that features closures in the back to prevent users from easily removing their life jackets, alleviating the risk of accidental drowning and to avoid the above-mentioned problems.

BRIEF SUMMARY OF THE INVENTION

In view of the foregoing disadvantages inherent in the known life preserver art, the present invention provides a novel life preserver vest. The general purpose of the present invention, which will be described subsequently in greater detail is to provide a wearable life preserver which features closures in the back, as opposed to the front to prevent users from easily removing their life jackets, alleviating the risk of accidental drowning.

A safety vest system is disclosed herein in a preferred embodiment comprising: a main body having a top side including a head opening, a bottom side including a body aperture, a front side having a V-shape neck opening and a base strap including a male base buckle. It further comprises a back side having a plurality of adjustable straps with buckles, a zipper, and a female base buckle. The safety vest main body is adapted to unzip from the back side to allow a user to be ensconced therein, with the top side head opening accommodating a user's head, and the bottom side body aperture accommodating a user's torso.

The front side V-shape neck opening allows sufficient space so as not to pinch the user's neck while in use. The base strap including the male base buckle is centrally located on the main body front side, and adapted to pass between a user's legs and be buckled to the female base buckle on the back side. The plurality of adjustable straps with buckles are able to be buckled together with the female buckles, which are integrally riveted onto the safety vest on the back side, and then adjusted to provide a secure fit on a user's body as needed.

The main body comprises a foam rubber material which is impervious to, and floats in water. It is encased in a nylon material which resists tearing for durability and longevity of use, and is waterproof to allow use in water with no degradation of material. The plurality of adjustable straps with buckles comprises one female buckle and one male buckle per strap, and are sewn on the front side to keep a user from removing them.

The safety vest is manufactured in various sizes to accommodate children as well as adults as needed, with the back side plurality of adjustable straps with buckles being length adjustable to accommodate different size bodies for security purposes. The front side base strap including male base buckle is able to prevent a user from removing the safety vest over the their head due to the base strap passing between the users legs, and buckling to the female base buckle on the back side.

The base strap including the male base buckle, plurality of adjustable straps with buckles, and zipper are located on the back side to prevent a user from reaching the buckles for safety. The plurality of adjustable straps with buckles are mounted in a parallel fashion around the main body for stability. Assistance from another person is necessary to install, buckle the plurality of adjustable straps with buckles, and alternately unbuckle, and remove the safety vest on a user for safety purposes. The safety vest is able to keep a user afloat in water while in use, due to the buoyancy of foam rubber material of the main body.

The present invention holds significant improvements and serves as a safety vest. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, safety vest system constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a safety vest and more particularly to a wearable life preserver which features closures in the back, as opposed to the front, as used to prevent users from easily removing their life jackets, alleviating the risk of accidental drowning.

Generally speaking, a safety vest is a life preserver having the zipper and buckles on the back side, instead of the front side, which prevents users from easily removing their life jacket and exponentially increasing their risk of drowning.

Figure 1:
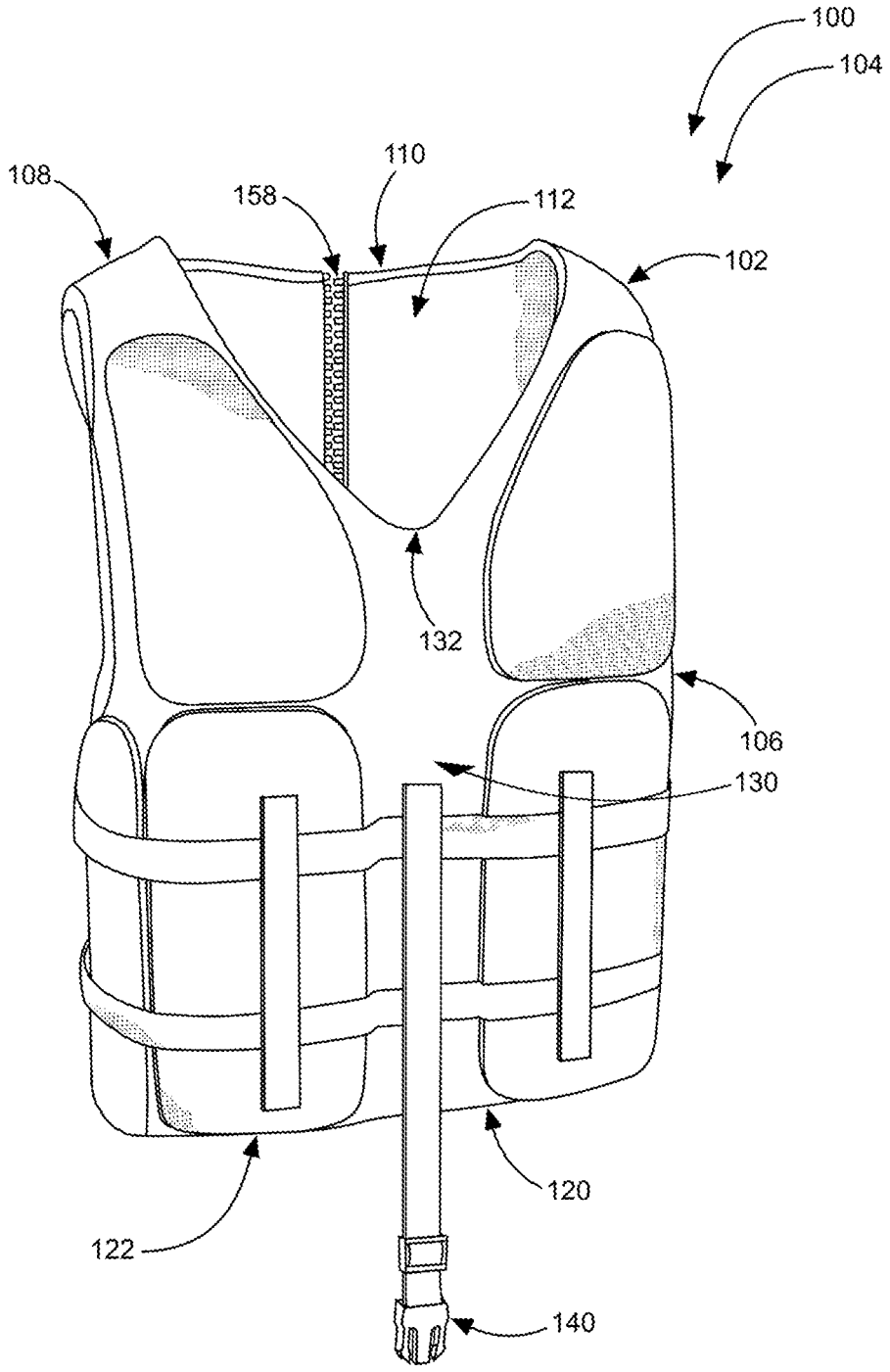
FIG. 1 shows a front perspective view illustrating a safety vest system according to an embodiment of the present invention.

Referring to the drawings by numerals of reference there is shown in FIG. 1, a front perspective view illustrating safety vest system 100 in an in-use condition 104 according to an embodiment of the present invention.

A safety vest system 100 is disclosed herein in a preferred embodiment comprising: main body 102 having top side 110 including head opening 112, bottom side 120 including body aperture 122, front side 130 having a V-shape neck opening 132 and base strap including a male base buckle 140. It further comprises back side 150 having plurality of adjustable straps with buckles 154, zipper 158, and female base buckle 160. Safety vest 100 main body 102 is adapted to unzip from back side 150 to allow a user to be ensconced therein, with top side 110 head opening 112 accommodating a user's head, and bottom side 120 body aperture 122 accommodating a user's torso.

Figure 2:
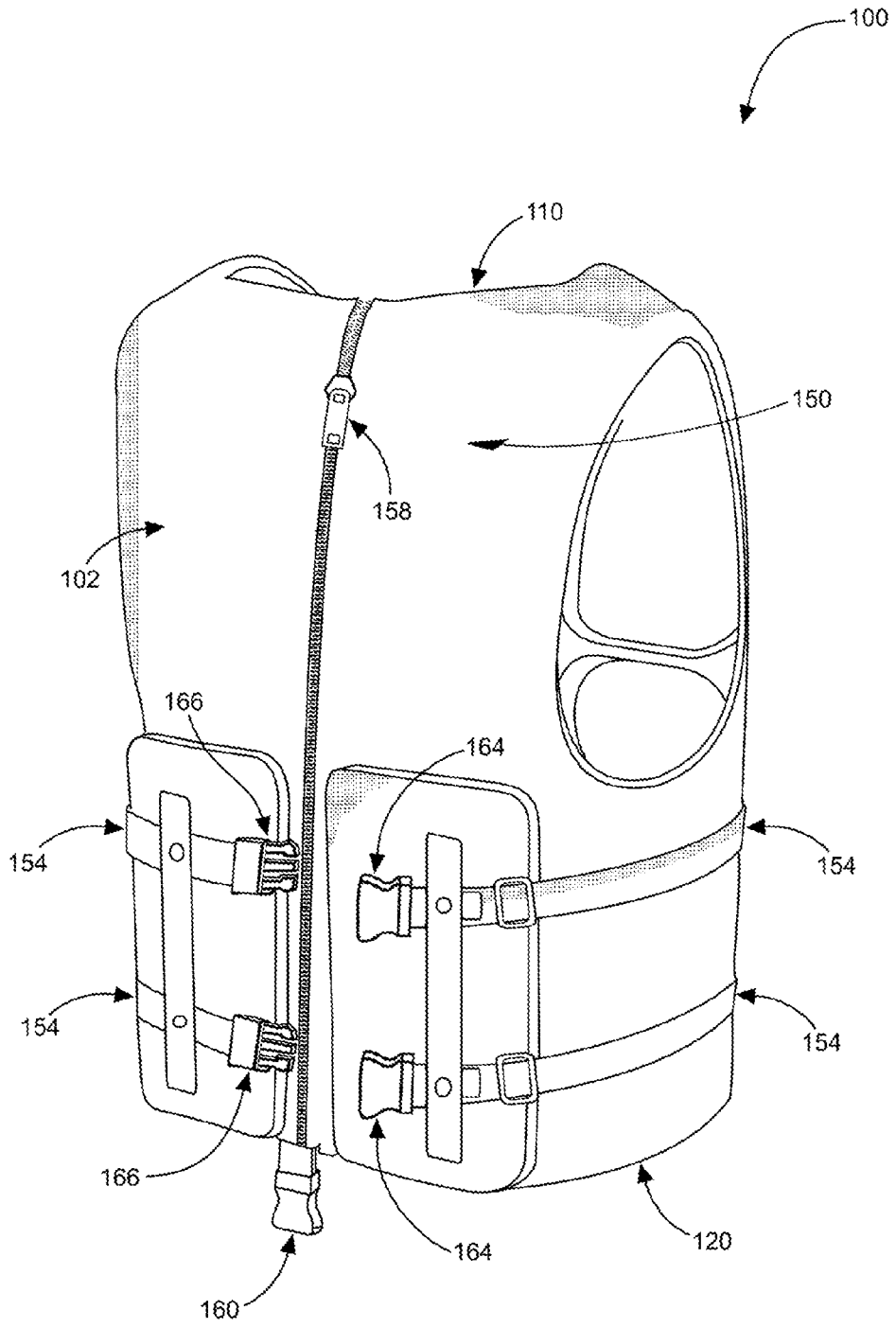
FIG. 2 is a back perspective view illustrating a safety vest system according to an embodiment of the present invention of FIG. 1.

Referring now to FIG. 2, a back perspective view illustrating a safety vest system 100 according to an embodiment of the present invention.

Front side 130 V-shape neck 132 opening allows sufficient space so as not to pinch the user's neck while in use. Base strap including a male base buckle 140 is centrally located on main body 102 front side 130, and adapted to pass between a user's legs and be buckled to female base buckle 160 on back side 150. Plurality of adjustable straps with buckles 154 are able to be buckled together with female buckles 164, which are integrally riveted onto safety vest 100 on back side 150, and then adjusted to provide a secure fit on a user's body as needed.

Figure 3:
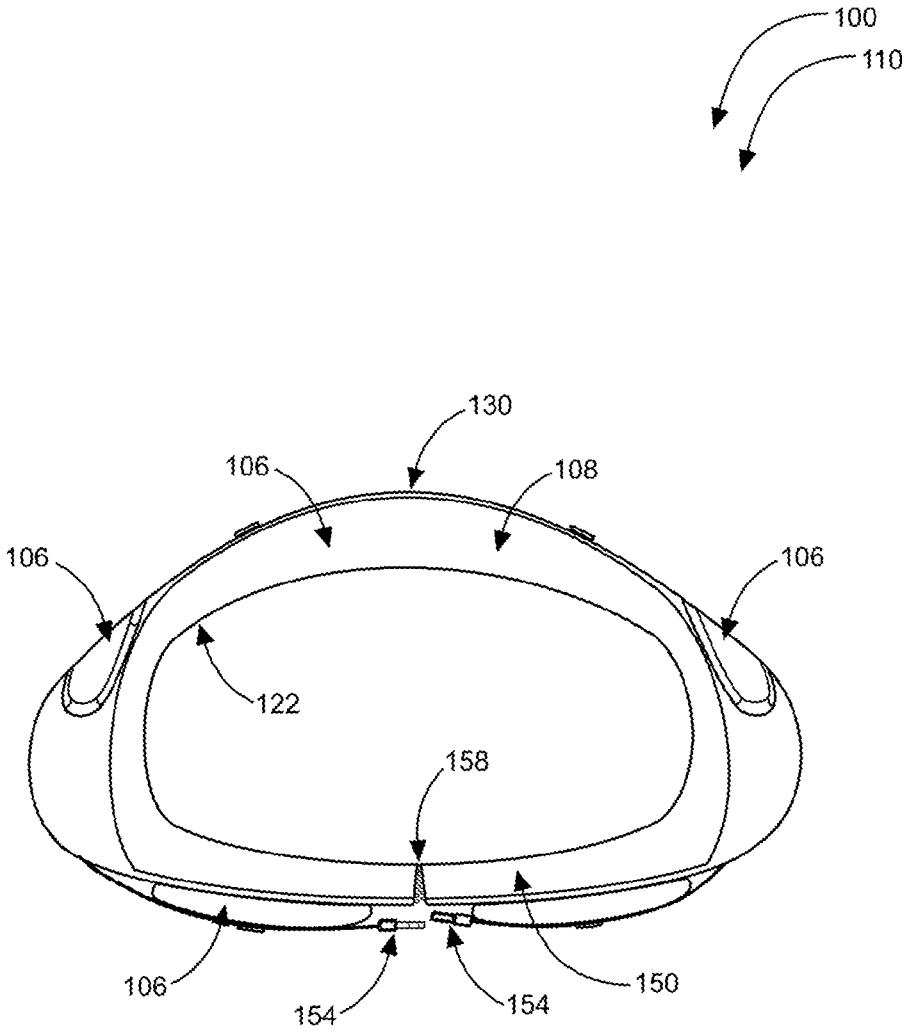
FIG. 3 is a top view illustrating safety vest system according to an embodiment of the present invention of FIG. 1.

Referring now to FIG. 3, a top view illustrating a safety vest system 150 according to an embodiment of the present invention.

Main body 102 comprises foam rubber material 106 which is impervious to, and floats in water. It is encased in nylon material 108 which resists tearing for durability and longevity of use, and is waterproof to allow use in water with no degradation of material. The plurality of adjustable straps with buckles 154 comprises one female buckle 164 and one male buckle 166 per strap, and are sewn on front side 130 to keep a user from removing them.

Figure 4:
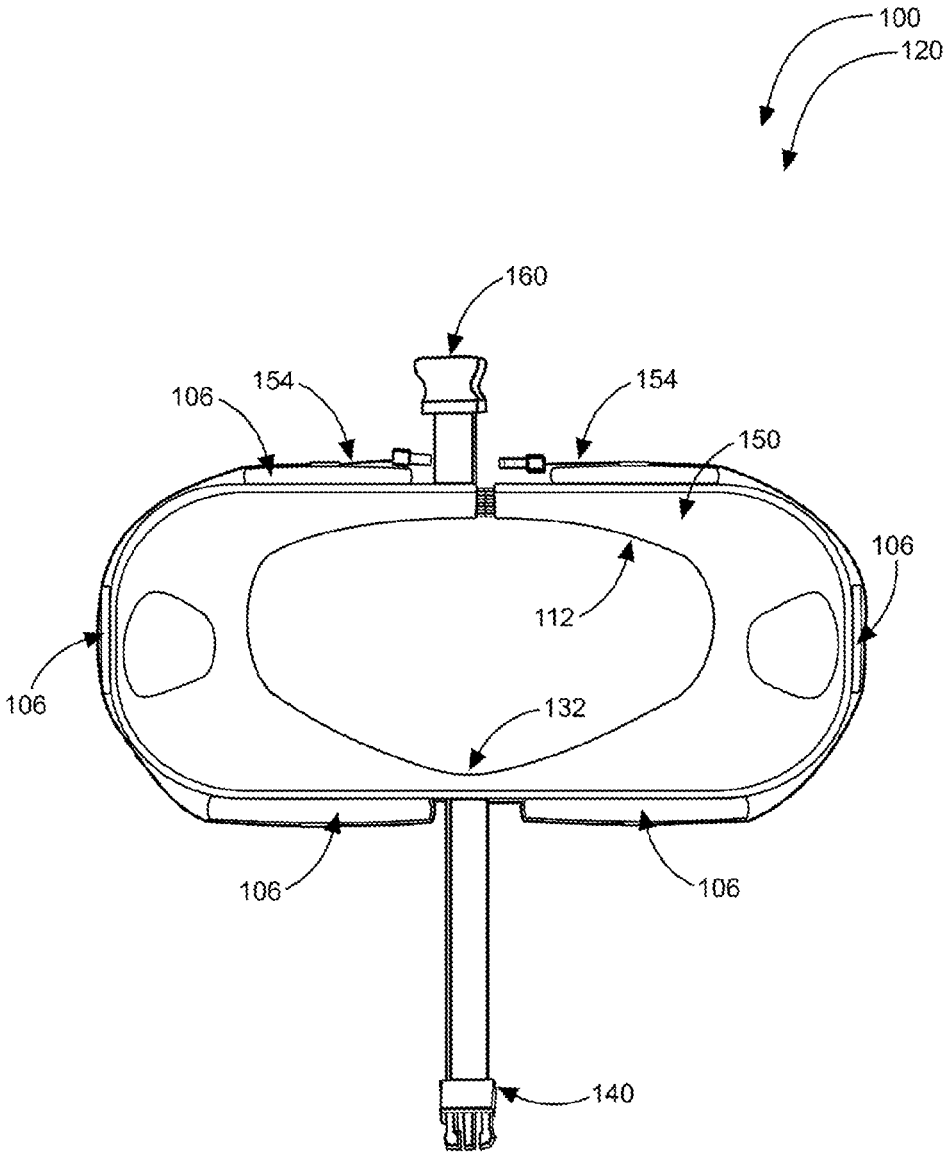
FIG. 4 is a bottom view illustrating safety vest system according to an embodiment of the present invention of FIG. 1.

Referring now to FIG. 4, showing a bottom view illustrating a safety vest system 100 according to an embodiment of the present invention.

Safety vest system 100 is manufactured in various sizes to accommodate children as well as adults as needed, with back side 150 plurality of adjustable straps with buckles 154 being length adjustable to accommodate different size bodies for security purposes. Front side 130 base strap including male base buckle 140 is able to prevent a user from removing safety vest 100 over their head due to base strap including a male buckle 140 passing between the users legs, and buckling to female base buckle 160 on back side 150. Base strap including a male base buckle 140, plurality of adjustable straps with buckles 154, and zipper 158 are located on back side 150 to prevent a user from reaching the buckles for safety. Plurality of adjustable straps with buckles 154 are mounted in a parallel fashion around main body 102 for stability. Assistance from another person is necessary to install, connect plurality of adjustable straps with buckles 154, and alternately unbuckle, and remove safety vest 100 on a user for safety purposes. Safety vest 100 is able to keep a user afloat in water while in use, due to the buoyancy of foam rubber material 106 of main body 102.

Safety Vest System 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A safety vest system is disclosed herein comprising:
- a main body having;
  - a top side including a head opening;
  - a bottom side including a body aperture;
  - a front side having;
    - a V shape neck opening;
    - a base strap including a male base buckle;
  - a back side having;
    - a plurality of adjustable straps with buckles;
    - a zipper; and
    - a female base buckle;

wherein said main body of the safety vest is adapted to unzip from said back side to allow a user to be ensconced therein, said top side of said head opening is adapted to accommodate said user's head, and said front side of said V shape neck opening is adapted to allow sufficient space so as not to pinch said users neck while in use, said base strap including said male base buckle is adapted to pass between said user's legs and be buckled to said female base buckle on said back side, said plurality of adjustable straps with buckles are adapted to be buckled together on said back side and adjusted to provide a secure fit on said users body as needed.

2. The safety vest system of claim 1 wherein said main body comprises a foam rubber material.

3. The safety vest system of claim 2 wherein said foam rubber material is impervious to water.

4. The safety vest system of claim 3 wherein said foam rubber material floats in water.

5. The safety vest system of claim 1 wherein said front side base strap base buckle is located on said main body such that it is adapted to pass between said users legs and removably attach to said female base buckle of said back side.

6. The safety vest system of claim 5 wherein said plurality of adjustable straps with buckles comprises one said female buckle and said one male buckle per strap to allow a connection and a disconnection thereof.

7. The safety vest system of claim 6 wherein said plurality of adjustable straps with buckles are sewn on said back sides to keep said user from removing said plurality of adjustable straps.

8. The safety vest system of claim 7 wherein said back side said plurality of adjustable straps with buckles are length adjustable to accommodate different size bodies for security purposes.

9. The safety vest system of claim 8 wherein said safety vest is manufactured in various sizes to accommodate children as well as adults as needed.

10. The safety vest system of claim 9 wherein said safety vest is adapted to keep said user from removing said safety vest due to said plurality of adjustable straps with buckles being on said back side of said safety vest.

11. The safety vest system of claim 5 wherein said front side said base strap including said male base buckle is adapted to prevent said user from removing said safety vest over said users head due to said base strap passing between said users legs and buckling to said female base buckle on said back side.

12. The safety vest system of claim 10 wherein said base strap including said male base buckle, said plurality of adjustable straps with buckles, and said zipper are located on said back side to prevent said user from reaching said buckles for safety.

13. The safety vest system of claim 7 wherein said plurality of adjustable straps with buckles are mounted in a parallel fashion around said main body.

14. The safety vest system of claim 1 wherein said zipper on said back side is manufactured with aluminum for longevity of use in any weather condition.

15. The safety vest system of claim 12 wherein assistance from another person is necessary to install, buckle said plurality of adjustable straps with buckles, and alternately unbuckle, and remove said safety vest on said user for safety purposes.

16. The safety vest system of claim 4 wherein said safety vest keeps said user afloat in water while in use due to buoyancy of said foam rubber material of said main body.

17. The safety vest system of claim 6 wherein said female buckles of said plurality of adjustable straps with buckles are integrally attached to said safety vest via rivets for durability and longevity of use.

* * * * *